US006260029B1

(12) United States Patent
Critelli

(10) Patent No.: US 6,260,029 B1
(45) Date of Patent: Jul. 10, 2001

(54) POSTAGE METER THAT PROVIDES ON A MAILPIECE EVIDENCE OF POSTAGE PAID TOGETHER WITH CRYPTOGRAPHICALLY SECURED, THIRD PARTY CERTIFIED, NON-SHIPPING INFORMATION ABOUT THE SENDER OF THE MAILPIECE

(75) Inventor: Michael J. Critelli, Darien, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/372,254

(22) Filed: Aug. 11, 1999

(51) Int. Cl.[7] ..... G07B 17/00
(52) U.S. Cl. ..... 705/408; 705/401
(58) Field of Search ..... 705/50, 64, 75, 705/76, 400, 401, 410, 408

(56) References Cited

U.S. PATENT DOCUMENTS

| | | | | |
|---|---|---|---|---|
| 5,153,842 | | 10/1992 | Dlugos, Sr. et al. | 364/478 |
| 5,288,994 | | 2/1994 | Berson | 250/223 R |
| 5,528,222 | * | 6/1996 | Moskowitz et al. | 340/572.7 |
| 5,586,036 | * | 12/1996 | Pintsov | 705/408 |
| 5,684,705 | | 11/1997 | Herbert | 364/464.11 |
| 5,796,841 | | 8/1998 | Cordery et al. | 380/55 |
| 5,925,865 | * | 7/1999 | Steger | 235/379 |
| 6,069,955 | * | 5/2000 | Coppersmith et al. | 380/54 |
| 6,073,121 | * | 6/2000 | Ramzy | 705/45 |
| 6,108,656 | * | 8/2000 | Durst et al. | 707/10 |

FOREIGN PATENT DOCUMENTS

WO 96/17329 * 6/1996 (WO) .

OTHER PUBLICATIONS

"Bar codes may help burst counterfeiters' buble": Automatic I.D. News; May 1998, v14, n6, p. 10.*

* cited by examiner

*Primary Examiner*—Edward R. Cosimano
(74) *Attorney, Agent, or Firm*—Steven J. Shapiro; Michael E. Melton

(57) ABSTRACT

A postage metering system that dispenses postage on a mailpiece, the postage metering system including accounting circuitry to account for the postage dispensed; apparatus for providing on the mailpiece evidence of postage paid and third party certified, cryptographically secured, non-shipping information about the sender of the mailpiece. A method implements the postage metering system described above.

24 Claims, 6 Drawing Sheets

POSTAGE METER THAT PROVIDES ON A MAILPIECE EVIDENCE OF POSTAGE PAID TOGETHER WITH CRYPTOGRAPHICALLY SECURED, THIRD PARTY CERTIFIED, NON-SHIPPING INFORMATION ABOUT THE SENDER OF THE MAILPIECE

FIELD OF THE INVENTION

The instant invention is directed to a value metering device, and more particularly to a postage meter that provides on a mailpiece evidence of postage paid together with cryptographically secured, third party certified, non-shipping information about the sender of the mailpiece.

BACKGROUND OF THE INVENTION

In today's environment organizations often solicit business by sending information via a common carrier, which for the purposes of this application includes any business involved in the physical delivery of items (i.e. U.S. POSTAL SERVICE®, FEDERAL EXPRESS®), to targeted recipients. The goal of the sending organization is typically to have the recipient procure an item or a service described in the information packet, but can also include, in the case of a charitable organization, a request for a contribution. Additionally, the information may simply be an introduction as to the capabilities/services of the sending organization which is intended to motivate the recipient to initiate follow-up discussions concerning the services and capabilities of the sender organization as they may be applied to the recipient's business. Unfortunately, in today's environment where mail fraud schemes are not uncommon, the recipient of the information packet often discards the information even if the product or services appear to be of some interest to the recipient. This predominantly occurs because the recipient is unfamiliar with the s sender organization and is reluctant to take any chance in conducting business with an unknown entity through the mail. In the event that the recipient does not discard the information packet they have two other alternatives. The first is that they can send money (or a check, etc.) through the mail for the product or service and risk not receiving the service or product if an unscrupulous sender is involved in the transaction. Alternatively, the recipient can perform some type of research on the sender organization to determine if they are reputable such as by contacting the Better Business Bureau or the Consumer Protection Agency. However, such research requires the use of resources which the recipient is unwilling to consume. As a result of the above, targeted direct mail business solicitations often do not generate a satisfactory business return rate.

In view of the above, it is desirable to provide a method and apparatus which provides on a mailpiece easily readable, cryptographically secured, third party certified, non-shipping information about the sender of the mailpiece.

SUMMARY OF THE INVENTION

It is an object of the invention to resolve the deficiencies discussed above by providing a postage metering system that dispenses postage on a mailpiece, the postage metering system including accounting circuitry to account for the postage dispensed; apparatus for providing on the mailpiece evidence of postage paid and third party certified, cryptographically secured, non-shipping information about the sender of the mailpiece. A method implements the postage metering system described above.

In yet another aspect of the invention it is desirable to provide an electronic indicium for use on an item being shipped by a sender to a recipient, the electronic indicium including an integrated circuit chip having a memory; and wherein the memory has stored therein evidence of shipping payment and third party certified, cryptographically secured, non-shipping information about the sender.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
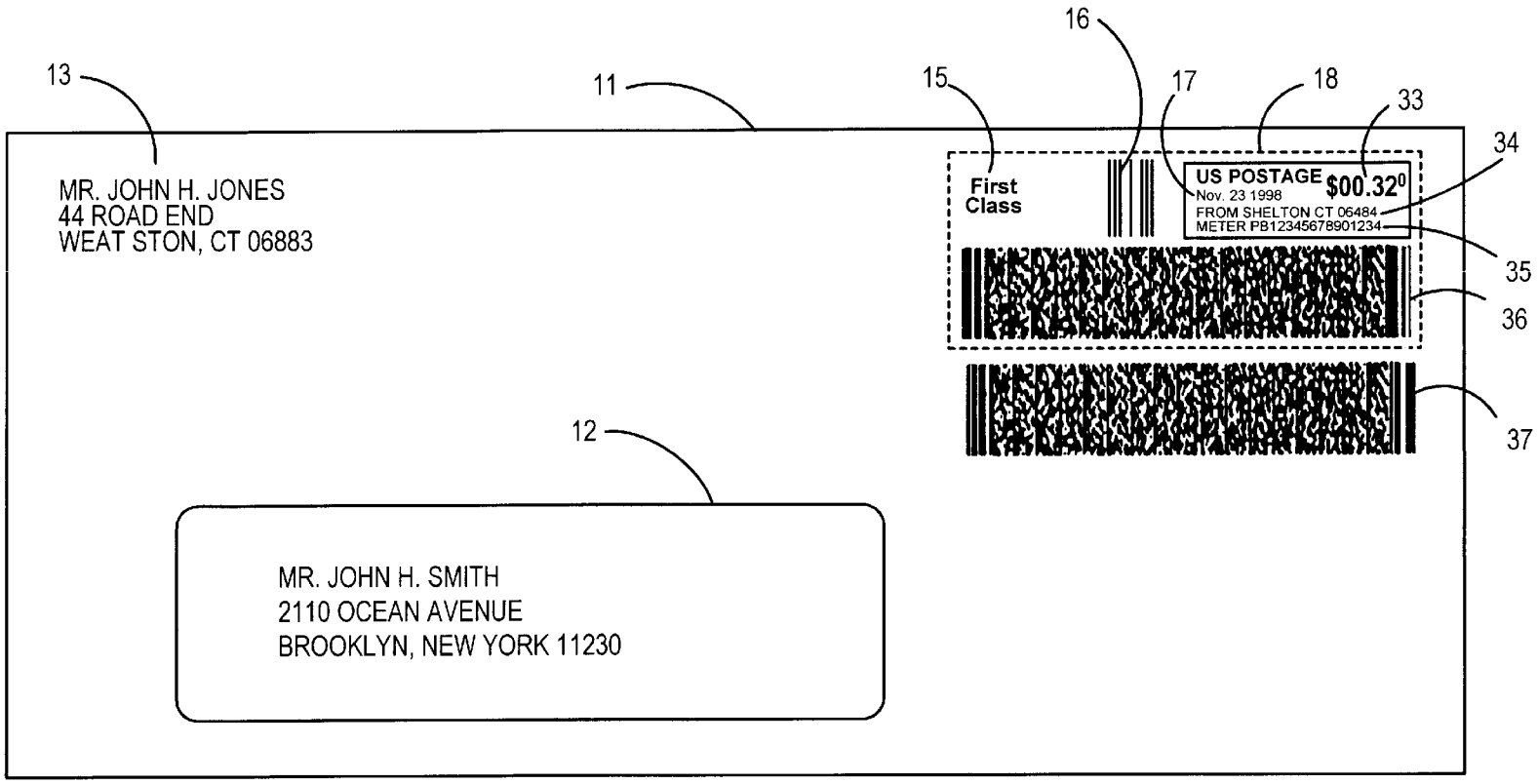
FIG. 1 shows a mailpiece including cryptographically secured, third party certified, non-shipping information about the sender of the mailpiece.

FIG. 1 is a drawing of a sealed mailpiece or sealed package 11 containing thereon a recipient address field 12, a sender address field 13, and a United States Postal Service Information—Based Indicia (IBI) 18. The indicia 18 contains a dollar amount 33, the date 17 that the postal indicia was affixed to container 11, the place 34 that container 11 was mailed, the postal security device (meter) serial number 35, the class of mail 15, a FIM code 16 and a 2D encrypted bar code 36. Bar code 36 includes cryptographically secured information that is derived from address field 12 and other information generated or contained in the postal security device that 15 affixed IBI 18 to the mailpiece 11. The manner in which the IBI 18 and bar code 36 is generated and affixed to mailpiece 11 is known in the art and currently incorporated in several vendor meter products.

The cryptographically secured information contained in bar code 36 includes information that has been digitally signed with the private key of the meter. Upon receipt of the mailpiece 11, the cognizant postal authority can obtain the public key that corresponds to the meters private key in order to verify the authenticity of the cryptographically secured information and correspondingly the authenticity of the IBI indicium 18.

Figure 2:
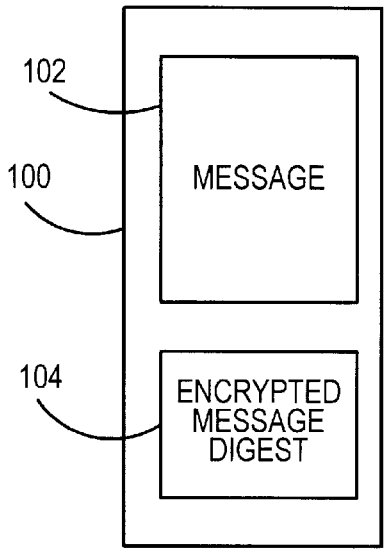
FIG. 2 shows a digitally signed document.

FIG. 2 shows that the cryptographically secured information included in bar code 36 may be in the form a digitally signed document 100. Document 100 includes a message 102 in clear text together with an encrypted digest 104 of message 102. Message 102 is the actual message being sent by the sender. The encrypted digest 104 is created, for example, by applying a one-way hash function to the message 102 to create a digest of the message and then encrypting the message digest utilizing the sender's private key and an encryption algorithm such as RSA (the encrypted message digest is also referred to as a "digital signature"). In operation, when a sender generates a document 100, the recipient verifies the authenticity of the document 100 upon receipt. That is, the recipient 1) generates a digest of the message 102 by applying the same one-way hash function to the message 102, 2) decrypts the received encrypted digest 104 using the sender's public key which is obtained from a data base available to the recipient, and 3) compares the generated message digest to the decrypted received message digest. If the digests fail to match, the recipient knows that the message is not authentic. On the other hand, if the digests match the information contained in the message 102 is considered as authentic information sent by the sender.

Figure 3:
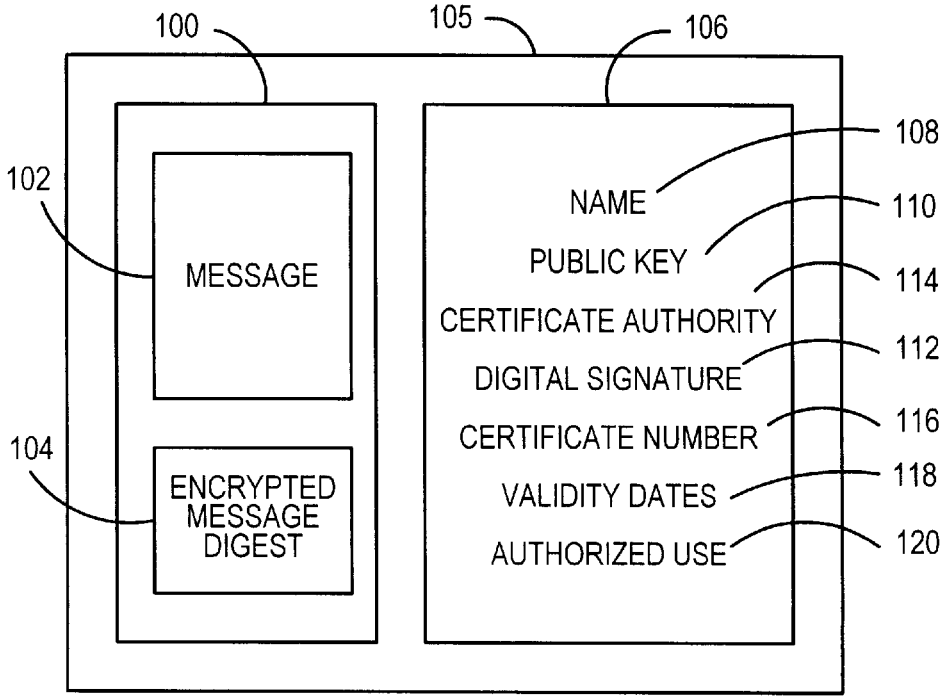
FIG. 3 shows a digitally signed document with a public key certificate.

As an alternative to FIG. 2, FIG. 3 shows a digitally signed document 100 with a public key certificate 106 attached thereto (hereinafter referred to as a "SMPKC" and shown at 105). The public key certificate 106 includes an identification of the certificate holder (sender) 108, the certificate holder's public key 110 which has been digitally signed with the private key of a certificate authority (certificate authority signature 112). Furthermore, the public key certificate 106 may also include the name of the certificate authority 114, a unique certificate number 116, the validity dates of the certificate 118 and any specified authorized use of the certificate 120. Alternatively, the public key certificate 106 may be delivered separately from the message 102 and encrypted digest 104 to a recipient. The use of the public key certificate 106 is particularly helpful in systems where communications bandwidth is small. In this case the public key certificate 106 need only be delivered once to each recipient.

Procedurally, when a sender generates a SMPKC 105, the recipient verifies the authenticity of the public key certificate 106 using the certificate authority's public key. Subsequently the recipient verifies that message 102 is authentic as discussed in connection with FIG. 2 using the sender's public key 110 obtained from the public key certificate 106.

While the use of the digitally signed document 100 or the SMPKC 105 has been used to verify the authenticity of the indicium 18 and to provide relevant shipping information to the postal authority (or other carrier), the instant inventor recognized that the same cryptographic techniques can be utilized to overcome the problems discussed above in connection with the discarding of targeted mail. That is, the instant invention includes on the mailpiece 11 additional cryptographically secured, third party certified, non-shipping related information about the sender which the recipient of the mailpiece 11 can read and verify as being authentic. The term "non-shipping information" excludes any shipping information related to the delivery of the mailpiece or the authentication of the evidence of postage paid such as that information typically included in a postage indicium. However, "non-shipping information " does include information generated by a trusted third party (other than sender) related to the financial aspects, creditworthiness, organizational structure, or ratings of the sender organization or its products. For example, the non-shipping information may include rating information by organizations such as Dunn & Bradstreet, Standard and Poors, or Moodys relating to the sender's business itself or product certifications such as an Underwriters Laboratory Inc. (UL) approval or compliance with standards and specifications such as those generated by the Institute of Electrical Electronics Engineers (IEEE) organization. The non-shipping information also may include a third party certification that the sender is a member in good standing of a particular organization or is appropriately licensed to do business within a specific jurisdiction.

Referring back to FIG. 1, the non-shipping information discussed above can is be included as part of the indicium 18 in a second bar code block 37. The non-shipping information may be in the form of the digital document 100 or SMPKC 105 such that the clear text message 102 (FIGS. 2 and 3) can be verified as being authentic. The difference between the cryptographically secured information in bar code 37 versus bar code 36 is that bar code 37 includes business information about the sender organization that is digitally signed by a trusted third party. Bar code 36 on the other hand includes postal verification information signed by the sender.

In operation, upon receipt by a recipient of the mailpiece 11, a conventional bar code scanner (not shown) can be used to read message 102 and the encrypted message digest 104 from the bar code 37. The extracted information can then be analyzed by a properly programmed computer device (not shown) to authenticate the message 102 and display message 102 to the recipient. The recipient now has valuable information from a trusted third party that is related to the business integrity of the sender. Accordingly, a much more informed decision can now be made by the recipient with respect to the received mailpiece regarding whether any follow-up activity is warranted by the recipient.

Figure 4:
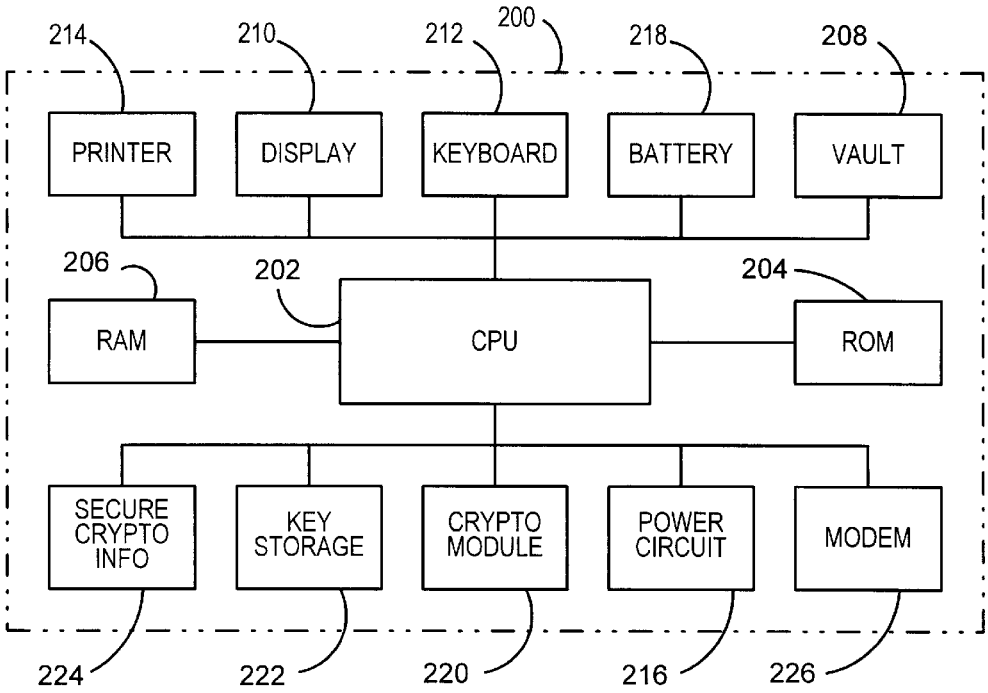
FIG. 4 is a block diagram of a postage meter for printing on the mailpiece of FIG. 1 the third party certified information.

Referring to FIG. 4, a postage meter 200 incorporating the instant invention is shown. Postage meter 200 includes a central processing unit (CPU) 202 which controls the operation of the postage meter 200 by executing programs stored in ROM 204 and utilizing RAM 206 for the temporary storage of information. Postage meter 200 further includes a conventional vault 208 that typical includes redundant registers for accounting for the amount of postage available to and dispensed by the postage meter 200. Additionally, the postage meter 200 includes a display 210, a keyboard 212, and a printer 214 that operate in a conventional manner to permit communication between the postage meter 200 and an operator. The printer 214 is used to print the indicium 18 together with bar code 37. The postage meter 200 is powered utilizing A.C. power via power circuit 216 or alternatively via a back-up battery source 218. A cryptographic module 220 generates the cryptographically secured shipping information contained in bar code 36 utilizing the private key of postage meter 200 that is stored in key storage device 222. The postage meter 200 also includes memory 224 where the trusted third party secure cryptographic information about the sender is maintained.

The postage meter 200 operates in a conventional manner to produce the indicium 18 with the bar code 36 information thereby permitting verification by the postal authority of the authenticity of the indicium 18. In addition, however, the postage meter 200 also retrieves the cryptographically secured, trusted third party certified, non-shipping information about the sender (hereinafter referred to as third party certificates) stored in module 224 and prints it as bar code 37. It is important to note that the third party certificates stored in module 224 can be loaded into the postage meter 200 at the time of manufacture or can be downloaded via communication with a remote data center (not shown) via a postage meter internal modem 226. Furthermore, a plurality of third party certificates can be stored in module 224. That is, the postage meter 200 can be programmed so that the user can select via the keyboard 212 which of the stored third party certificates should be included in bar code 37. Thus, the user can selectively decide for particular mailings which third party certificates to include or not include on the mailpiece depending is upon the target audience of the specific mailing. For example, if advertising material about a product is included in the mailing, the sender might only want to include a certified rating of the product by an organization such as the Underwriters Laboratory Inc. On the other hand if the mailing is describing services provided by the sender, third party certified information about the creditworthiness or financial stability of the sender organization may be appropriate to include in bar code 37.

While the above description sets forth the process of including the third party certificates as part of the printed postage indicium, the amount of information that can be included is limited by the available mailpiece 11 print area and the bar code format used. In order to permit significantly more third party certificate information to be included on the mailpiece 11, it is desirable to use an integrated circuit attached to the mailpiece 11 within which the postage indicium and the third party certificates are contained in lieu of the printed indicium 18 and bar code 37. The use of such an electronic circuit for conveying postage verification/shipping information related to the mailpiece 11 is known from U.S. Pat. Nos. 5,153,842, and 5,684,705, which are incorporated herein by reference.

Figure 5:
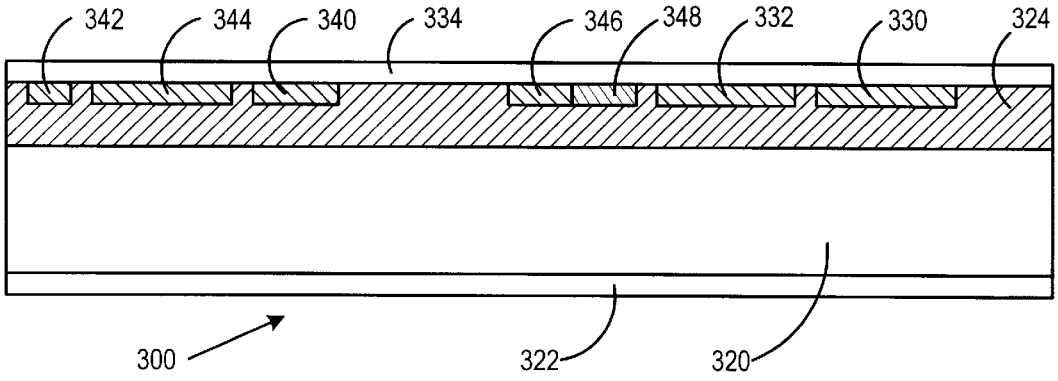
FIG. 5 is a cross-section of an electronic circuit for use on a mailpiece.
Figure 6:
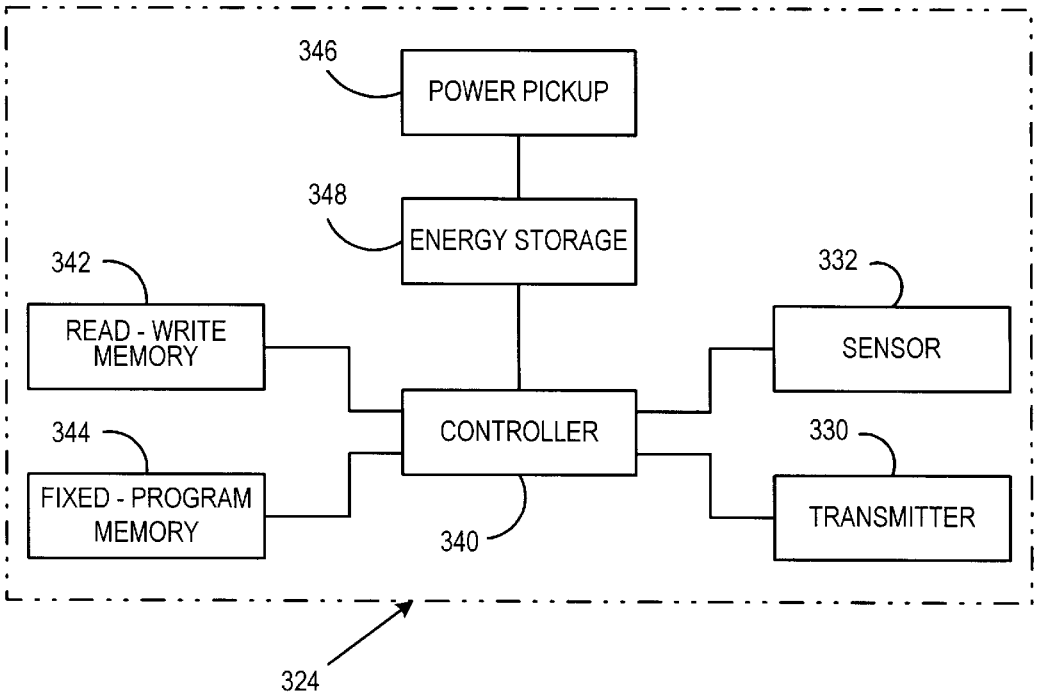
FIG. 6 is a block diagram of the electrical components of the electronic circuit of FIG. 5.

FIGS. 5 and 6 respectively show the cross section of an electronic circuit 300 that can be affixed to mailpiece 11 and a block diagram of the electronic components of the electronic circuit 300. Electronic circuit 300 is produced on a thin substrate, such as a paper layer 320, which, preferably, has an adhesive layer 322 for affixing circuit 300 to the mailpiece 11. Circuit 300 also includes an electronic material layer 324 which contains all the necessary electronic components described below, and a window layer 334 which serves as a protective layer for electronic material layer 324. Preferably, the electronic components in the electronic material layer 324 are made from a semiconductor material. The electronic material layer 324 also includes a sensor 332 and a signal transmitter 330 to allow circuit 300 to communicate with external devices, a power pick-up 346 to receive power from an external radio frequency (RF) source, an energy storage device 348, a controller 340 and memories 342 and 344. The memory 342 is a read/write memory within which the indicium 18 information for a particular mailing including the third party certificate information is stored. The memory 44 stores the operating programs utilized by controller 340 in performing the operations discussed sensor 332 is capable of receiving RF signals while transmitter 330 is preferably a radio frequency transmitter for transmitting RF signals. It is also preferred that layer 324 is activated only when it is in the proximity of a postal or courier reading device. Thus, it is preferable that that power pickup unit 346 receive power from an external RF source i.e., the postal or courier reading device, and that energy storage device 348 includes one or more capacitors and a voltage regulator for storing the received power and providing it to electronic circuit 300.

Figure 7:
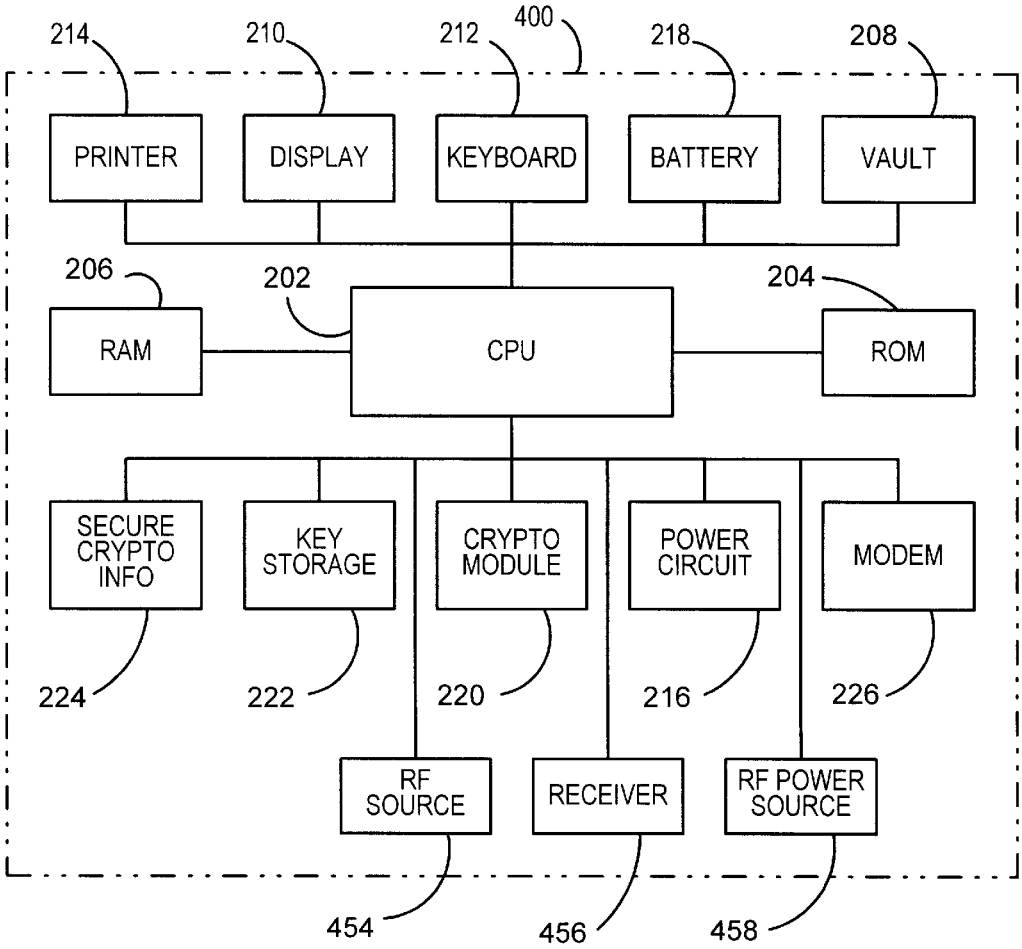
FIG. 7 is a block diagram of a postage meter for use in conjunction with the electronic circuit of FIGS. 5 and 6.

FIG. 7 is a drawing in block form showing how information may be loaded into and received from electronic circuit 300 via postage meter 400. Similarly labeled components of FIGS. 4 and 7 have the same functionality such that a repeat description is not considered warranted in connection with FIG. 7. Postage meter 400 includes a RF power source 458 for providing energy to circuit 300 when source 458 is in the proximity of circuit 300. A radio frequency source 454 is provided for transmitting both the standard IBIP indicium data and the third party certificates to controller 340 via sensor 332. A receiver 456 receives information from controller 340 via transmitter 330. Accordingly, when a sender desires to mail a mailpiece, the mailpiece 11 with the electronic circuit 300 attached thereto is placed in close proximity to power source 458 thereby energizing electronic circuit 300. The user then via keyboard 212 enters the desired postage amount and the selected third party certificates that are to be included in the indicium 18. The CPU 202 generates the proof of postage payment including the postage verification data in a conventional manner and sends that data together with the selected stored third party certificate data to the sensor 332 in an RF form via RF source 454. A recipient of the mailpiece 11 places the mailpiece 11 in close proximity to their postage meter 400 allowing the electronic circuit 300 to be powered up so that the third party certificate data in the electronic circuit can be transmitted via the transmitter 330 to the receiver 456. The CPU 202 then verifies the authenticity of the third party certificates as discussed above and upon verification displays the authenticated information to the recipient via the printer 214 or the display 210. The recipient now has the authenticated third party non-shipping information about the sender.

It is clear from the above description that the instant invention provides a significant new method for conveying third party certified information about the sender of a mailpiece utilizing the postage indicium as a carrier of such information. This capability will provide mailpiece recipients with readily available information that can used to make a more informed decision about further actions that may be warranted in connection with a specific mailpiece.

Additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims. For example, the following variations from the preferred embodiments are possible:

1. The bar code 36 of the IBI 18 is shown in a bar code format because more information per unit of mailpiece real estate can be included as compared to printing the encrypted information in a numeric or alphanumeric form. However, the bar code 36 can be replaced with encrypted numerical or alphanumerical data.

Figure 8:
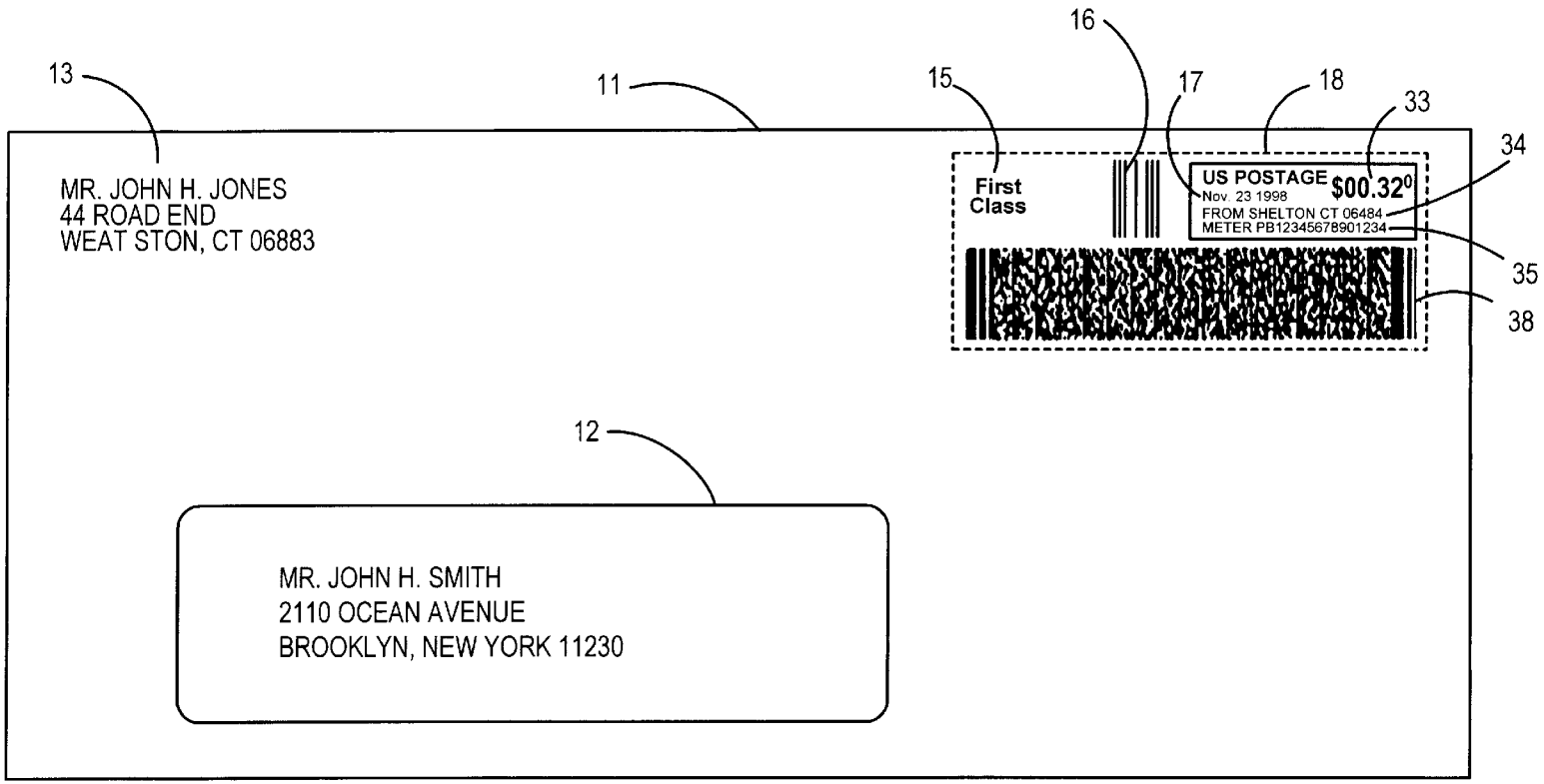
"FIG. 8 shows a mailpiece similar to FIG. 1 but with only a single bar code".

2. Additionally, for ease of explanation the third party, certified, cryptographically secured, non-shipping data is shown in a separate bar code 37 but could easily be included as part of the bar code 36 together with the indicium verification data. FIG. 8 shows a mailpiece 11 having a single bar code 38 that includes both the evidence of payment together with the third party, certified, cryptographically secured, non-shipping, non-product information about the sender.

3. While the electronic circuit 300 is shown as a device which can communicate with a read/write apparatus via RF communications, other types of contactless communications are possible such as infrared, visible light, or variations in magnetic or electrical fields. Appropriate sensors and transmitters for each of these technologies can be substituted for the communication sensors and transmitters discussed above.

4. The electronic circuit 300 may also be in the form of a circuit that requires physical electrical contact to be made between itself and the read/write mechanism. Such devices are readily available and commonly referred to as smart devices or smart cards.

5. The recipient of the mailpiece 11 need not have a postage meter 400 to read the third party certificate data, but in lieu thereof can have a simple reading device.

6. In the operation of postage meter 400, the third party public key information needed to authenticate the third party certificates can be stored in the postage meter 400 or alternatively can be resident in a remote database. In the latter situation, the postage meter 400, via modem 226, sends the third party certificate to the data center (not shown) for authentication. The data center would, upon authentication, send the message 102 back to the postage meter 400 for display on display 210 or to be printed by printer 214.

7. While the electronic circuit 300 is shown as having a controller 340, in a simpler version the electronic device 300 can be a simple memory card which can be read and written to by an external circuit. Additionally, while the electronic circuit 300 is shown as being on the outside of the mailpiece 11, it could also be located inside of the mailpiece since the contactless communications would still be possible with an external circuit.

8. Finally, in the preferred embodiment, a public key cryptographic system is shown for protecting the information contained in the indicium, however, one skilled in the art will recognize that a secret key system could be used in lieu thereof.

What is claimed is:

1. An electronic indicium for use on an item being shipped by a sender to a recipient, the electronic indicium comprising:

an integrated circuit chip having a memory; and wherein the memory has stored therein evidence of shipping payment and third party certified, cryptographically secured, non-shipping, non-product information about the sender.

2. An electronic indicium as recited in claim 1, wherein the third party certified, cryptographically secured, non-shipping, non-product information about the sender is information about the credit worthiness of the sender.

3. An electronic indicium as recited in claim 1, wherein the third party certified, cryptographically secured, non-shipping, non-product information about the sender is information about at least one of the financial status and the organizational structure of the sender.

4. An electronic indicium as recited in claim 1, wherein the third party certified, cryptographically secured, non-shipping, non-product information about the sender is information about a rating of the sender by the third party.

5. An electronic indicium as recited in claim 1, wherein the electronic indicium is a postage indicium including evidence of postage paid.

6. An electronic indicium as recited in claim 1, wherein the integrated circuit chip further includes means for interfacing with an external circuit to permit the external circuit to obtain the third party certified, cryptographically secured, non-shipping, non-product information about the sender from the memory.

7. An electronic indicium as recited in claim 6, wherein the integrated circuit chip further includes a processor which communicates with the external circuit via the interfacing means to exchange the third party, certified, cryptographically secured, non-shipping, non-product information about the sender between the processor and the external circuit.

8. A postage metering system that dispenses postage on a mailpiece, the postage metering system comprising:

accounting circuitry to account for the postage dispensed;

means for providing on the mailpiece evidence of postage paid and third party certified, cryptographically secured, non-shipping, non-product information about the sender of the mailpiece.

9. A postage metering system as recited in claim 8, wherein the providing means includes an electronic indicium attached to the mailpiece, the electronic indicium including an integrated circuit chip having a processor, a memory, and means for interfacing with an external circuit, and wherein the memory has stored therein the evidence of postage paid and a cryptographically secured certificate issued by a third party which certificate includes non-shipping, non-product information about the sender of the mailpiece, and wherein the processor via the interfacing means transmits the non-shipping information for receipt by the external circuit.

10. A postage metering system as recited in claim 8, wherein the providing means includes a printer which prints the evidence of postage paid and the third party, certified, cryptographically secured, non-shipping, non-product information about the sender on the mailpiece.

11. A postage metering system as recited in claim 10, wherein the third party certified, cryptographically secured, non-shipping, non-product information about the sender is at least one of a creditworthiness assessment, a financial report about the sender, and an organizational structure of the sender.

12. A method for providing information on an item being shipped, the method comprising the steps of:

A) providing on the item evidence that shipping costs for the item have been paid; and B) providing on the item third party certified, cryptographically secured non-shipping, non-product information about the sender of the item.

13. A method as recited in claim 12, wherein the item being shipped is a mailpiece and the evidence of step A and the third party certified, cryptographically secured, non-shipping, non-product information about the sender of step B are included as a single indicium.

14. A method as recited in claim 13, further providing printing the single indicium on the item.

15. A method as recited in claim 13, further comprising attaching a memory device to the item and storing the single indicium as readable data within the memory device.

16. An electronic indicium for use on an item being shipped by a sender to a recipient, the electronic indicium comprising:

an integrated circuit chip having a memory; and wherein the memory has stored therein evidence of shipping payment and third party certified, cryptographically secured, non-shipping information about the sender and wherein the third party certified, cryptographically secure, non-shipping information about the sender is information about at least one of credit worthiness of the sender, financial status of the sender, the organizational structure of the sender, a rating of the sender by the third party, and a rating of a sender product by the third party.

17. An electronic indicium as recited in claim 16, wherein the third party certified, cryptographically secured, non-shipping information about the sender is information about the credit worthiness of the sender.

18. An electronic indicium as recited in claim 16, wherein the third party certified, cryptographically secured, non-shipping information about the sender is information about at least one of the financial status and the organizational structure of the sender.

19. An electronic indicium as recited in claim 6, wherein the third party certified, cryptographically secured, non-shipping information about the sender is information about at least one of a rating of the sender by the third party and the rating of a sender product by the third party.

20. A postage metering system that dispenses postage on a mailpiece, the postage metering system comprising:

accounting circuitry to account for the postage dispensed;

means for providing on the mailpiece evidence of postage paid and third party certified, cryptographically secured, non-shipping information about the sender of the mailpiece; and wherein the third party certified, cryptographically secured, non-shipping information about the sender is at least one of a creditworthiness assessment, a product rating, a financial report about the sender, and an organizational structure of the sender.

21. A method for providing information on an item being shipped, the method comprising the steps of:

providing on the item evidence that shipping costs for the item have been paid; and providing on the item third party certified, cryptographically secured, non-shipping information about the sender of the item, wherein the third party certified, cryptographically secure, non-shipping information about the sender is information about at least one of credit worthiness of the sender, financial status of the sender, the organizational structure of the sender, a rating of the sender by the third party, and a rating of a sender product by the third party.

22. A method as recited in claim 21, wherein the third party certified, cryptographically secured, non-shipping information about the sender that is provided is information about the credit worthiness of the sender.

23. A method as recited in claim 21, wherein the third party certified, cryptographically secured, non-shipping information about the sender that is provided is information about at least one of the financial status and the organizational structure of the sender.

24. A method as recited in claim 21, wherein the third party certified, cryptographically secured, non-shipping information about the sender that is provided is information about at least one of a rating of the sender by the third party and the rating of a sender product by the third party.

* * * * *